US009352346B2

(12) United States Patent
Bertin et al.

(10) Patent No.: US 9,352,346 B2
(45) Date of Patent: May 31, 2016

(54) FLUID DISPENSER

(71) Applicant: APTAR FRANCE SAS, Le Neubourg (FR)

(72) Inventors: Romain Bertin, Evreux (FR); Pierre-Alain Lesage, Sotteville Les Rouen (FR)

(73) Assignee: APTAR FRANCE SAS, Le Neubourg (FR)

( * ) Notice: Subject to any disclaimer, the term of this patent is extended or adjusted under 35 U.S.C. 154(b) by 3 days.

(21) Appl. No.: 14/151,341

(22) Filed: Jan. 9, 2014

(65) Prior Publication Data

US 2014/0197208 A1 Jul. 17, 2014

Related U.S. Application Data

(60) Provisional application No. 61/759,794, filed on Feb. 1, 2013.

(30) Foreign Application Priority Data

Jan. 11, 2013 (FR) ..... 13 50273

(51) Int. Cl.
*B65D 88/54* (2006.01)
*B05B 11/00* (2006.01)

(52) U.S. Cl.
CPC ..... *B05B 11/3001* (2013.01); *B05B 11/0056* (2013.01)

(58) Field of Classification Search
CPC ..... B65B 3/18; B65B 3/12; B65B 3/04; B05B 11/3001; B05B 11/0056
USPC ..... 222/402.16, 402.18, 321.1–321.9, 320; 141/113, 18, 20
See application file for complete search history.

(56) References Cited

U.S. PATENT DOCUMENTS

| | | | | |
|---|---|---|---|---|
| 3,559,701 | A | 2/1971 | Wittersheim et al. | |
| 7,743,949 | B2 * | 6/2010 | Ramet | 222/321.9 |
| 2011/0309113 | A1 * | 12/2011 | Hui et al. | 222/402.16 |
| 2014/0060695 | A1 * | 3/2014 | Dumont et al. | 141/18 |
| 2014/0137983 | A1 * | 5/2014 | Tu | 141/113 |

FOREIGN PATENT DOCUMENTS

| | | | |
|---|---|---|---|
| EP | 2 383 204 | A1 | 11/2011 |
| GB | 2 229 380 | A | 9/1990 |

* cited by examiner

*Primary Examiner* — Lien Ngo
(74) *Attorney, Agent, or Firm* — Sughrue Mion, PLLC

(57) ABSTRACT

A refillable fluid dispenser having a fluid reservoir defining a neck and a bottom walk; a filling valve; a dispenser member, such as a pump; a pusher that is mounted on the dispenser member; and a vent channel that extends along the fluid reservoir and that is made integrally with the fluid reservoir. The dispenser includes a stationary element that is mounted on the bottom wall of the fluid reservoir, the stationary element forming a vent passage that connects the outlet of the vent channel to the outside.

15 Claims, 2 Drawing Sheets

FLUID DISPENSER

CROSS REFERENCE TO RELATED APPLICATION

This application claims the benefit under 35 U.S.C. §119 (e) of U.S. provisional patent application Ser. No. 61/759,794, filed Feb. 1, 2013, and priority under 35 U.S.C. §119(a)-(d) of French patent application No. FR-13 50273, filed Jan. 11, 2013.

TECHNICAL FIELD

The present invention relates to a refillable fluid dispenser comprising:

- a fluid reservoir defining a neck and a bottom wall;
- a filling valve that is mounted in the bottom wall, the filling valve including a movable member and a stationary element forming a valve seat for the movable member;
- a dispenser member, such as a pump, that is mounted on the reservoir so as to take the fluid;
- a pusher that is mounted on the dispenser member; and
- a vent channel that extends along the fluid reservoir so as to put the fluid reservoir into communication with the outside, the vent channel defining an inlet in the proximity of the neck, and an outlet that opens out at the bottom wall.

An advantageous field of application of the present invention is the field of perfumery, without forgetting the fields of cosmetics and pharmacy.

BACKGROUND OF THE INVENTION

In the prior art, document U.S. Pat. No. 3,559,701 is already known that describes a refillable dispenser comprising: a reservoir; a filling valve that is mounted in the bottom wall of the reservoir; a dispenser member in the form of a valve; a pusher that is mounted on the dispenser valve; and a vent channel that extends along the reservoir from the bottom wall into the proximity of the neck. When the fluid is injected into the reservoir through the filling valve forced into its open state, the air contained in the reservoir may be evacuated through the vent channel. In that prior-art document, the vent channel is in the form of a fine tube that is mounted on the bottom wall of the reservoir and that extends freely inside the reservoir. It can easily be understood that that vent-channel design is difficult to implement at relatively low cost. It should be observed that that document is more than forty years old.

Document GB 2 229 380 is also known that describes a refillable dispenser comprising a reservoir, a pump, a pusher, and a vent channel that is made integrally with the reservoir. The refillable dispenser does not include a genuine filling valve: instead, a cone defining a small passage makes it possible to receive the actuator rod of a pump of a source bottle. Fluid may thus be injected into the reservoir, and the air contained in the reservoir may escape through the vent channel. The refillable dispenser also includes a removable cap that can be fitted to the bottom wall of the reservoir in such a manner as to close both the cone and the outlet of the vent channel. In this respect, the design of the vent channel that is incorporated in the reservoir cannot be provided in industrial manner and at moderate cost. The vent channel is shown with a section that is constant over its entire length, which would signify that it has been made by means of a fine pin of section that is constant, which is not possible in practice. Such a pin could not be removed from the channel after molding as a result of its long length and its extreme fineness.

BRIEF SUMMARY OF THE INVENTION

An object of the present invention is to remedy the above-mentioned drawbacks of the prior art by defining a refillable dispenser having a vent channel that is incorporated in the reservoir, but without generating complications with regard to molding the reservoir and its vent channel. It must be possible to mold and unmold the vent channel rapidly by means of a robust pin.

To achieve these objects, the present invention proposes a refillable fluid dispenser comprising: a fluid reservoir defining a neck and a bottom wall provided with an opening; a filling valve that is mounted in the opening of the bottom wall, the filling valve including a movable member and a valve seat for the movable member; a dispenser member, such as a pump, that is mounted on the reservoir so as to take the fluid, the dispenser member including a body and an actuator rod that is axially movable down and up; a pusher that is mounted on the actuator rod of the dispenser member; and a vent channel that extends along the fluid reservoir so as to put the fluid reservoir into communication with the outside, the vent channel defining an inlet in the proximity of the neck, and an outlet that opens out at the bottom wall, the vent channel being made integrally with the fluid reservoir; the dispenser being characterized in that it includes a stationary element that is mounted on the bottom wall of the fluid reservoir, the stationary element forming a vent passage that connects the outlet of the vent channel to the outside. Thus, the stationary element forms a kind of extension of the vent channel by forming a terminal vent passage before opening out to the outside. As a result, it is possible to make the vent channel with a section that is larger, and with a shape that is conical or that tapers, for example. Thus, the outlet of the vent channel presents a flow section that is larger than the flow section of the inlet. The vent channel may present a configuration that flares towards its outlet.

In addition, the vent passage that connects the outlet of the vent channel to the outside may present a flow section that is smaller than the flow section of the vent channel so as to create considerable head loss, thereby preventing any fluid from leaking. By way of example, the vent passage presents a flow section that is smaller than the flow section of the outlet.

In a very simple embodiment, the vent passage comprises a vent hole that is arranged at the outlet. However, when the vent hole connects the outlet of the vent channel directly to the outside, the stationary element needs to be orientated, given that the vent channel is arranged in off-center manner. Thus, the vent passage preferably comprises an annular duct and a vent hole, the annular duct connecting the outlet to the vent hole. In this way, it is not necessary to index the orientation of the stationary element, since the annular duct, as a result of its annular shape, is always situated facing the outlet of the vent channel. Furthermore, the annular duct constitutes a vent-passage segment that may be made with a section that is very constricted.

In a practical embodiment, the stationary element includes a disk that is provided with an annular groove in which there is formed a vent hole that passes through the thickness of the disk.

According to another advantageous characteristic of the invention, the stationary element also forms the valve seat of the filling valve. By way of example, the valve seat may be formed at the center of the disk.

According to another advantageous characteristic of the invention, the movable member of the filling valve comprises a slotted flexible diaphragm that bears in leaktight manner on the valve seat, in the rest position. Preferably, the slotted flexible diaphragm is formed by a flexible part that further includes an annular anchor band in which the slotted flexible diaphragm extends, the annular anchor band being jammed between the bottom wall and the stationary element.

In another aspect of the invention, the dispenser further comprises a removable cap that covers the stationary element in airtight manner.

The spirit of the invention stems from it being easier and less costly to incorporate the vent channel in the reservoir. However, molding as a single part requires the vent channel to be of a certain section and of a certain shape, and this could generate risks of leakage. In order to eliminate the risks of leakage, the vent channel is extended by a vent passage of section that is smaller, which vent passage is formed by a stationary element that is fitted on the bottom wall of the reservoir. Ingeniously, the stationary element also forms the seat of the filling valve.

BRIEF DESCRIPTION OF THE DRAWINGS

The invention is described more fully below with reference to the accompanying drawings, which shows an embodiment of the invention by way of non-limiting example.

In the figures.

DETAILED DESCRIPTION

Figure 1:
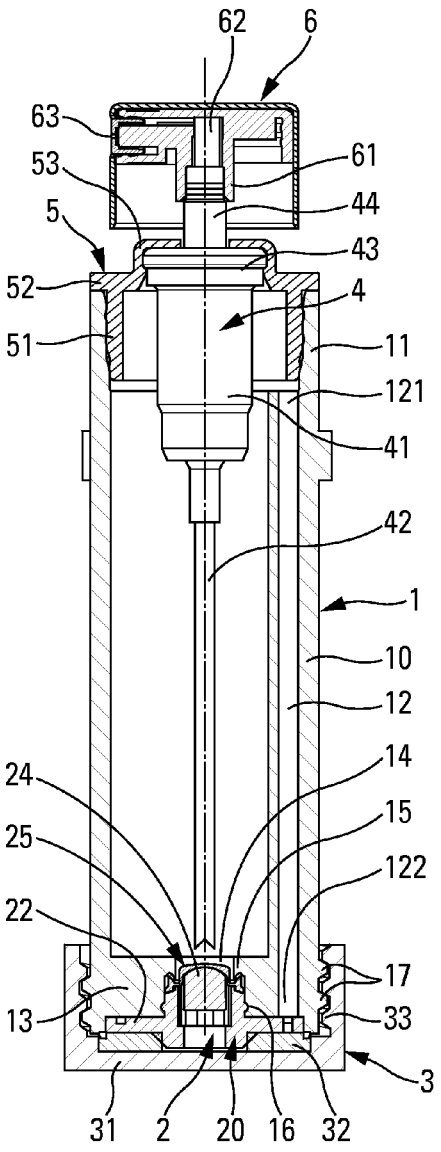
FIG. 1 is a vertical section view through a dispenser made in accordance with the invention.
Figure 2:
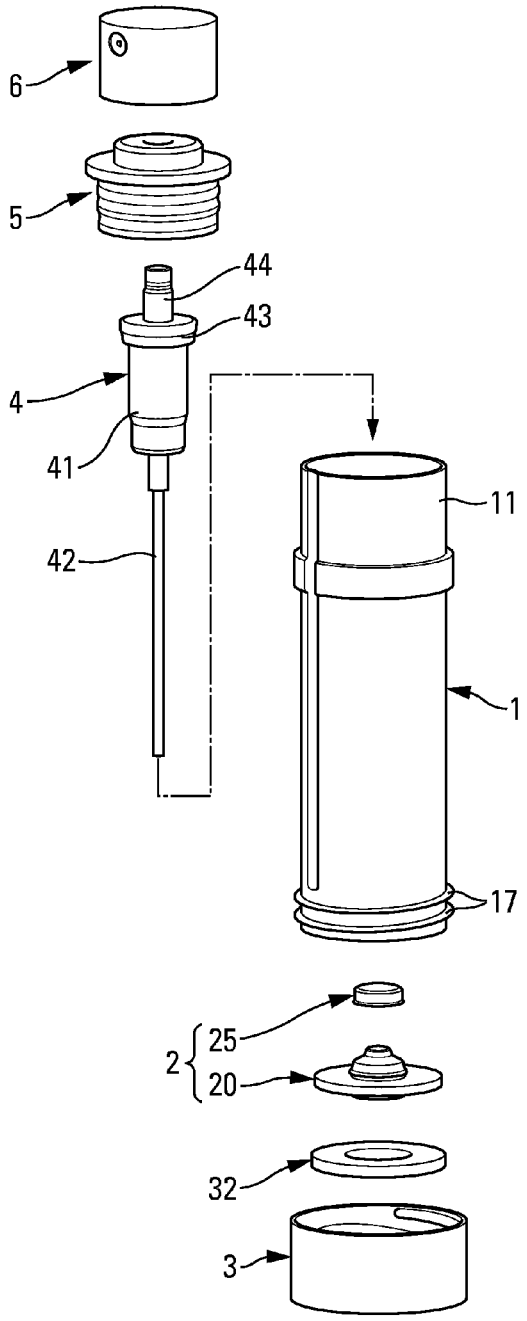
FIG. 2 is an exploded perspective view of the FIG. 1 dispenser.

Reference is made firstly to FIGS. 1 and 2 in order to describe, in overall manner, the structure of a refillable fluid dispenser in a non-limiting embodiment of the invention. The dispenser comprises the following component elements, namely a fluid reservoir 1, a filling valve 2, an optional removable cap 3, a dispenser member 4, a fastener ring 5, and a pusher 6.

By way of example, the dispenser member 4 may be a pump comprising a pump body 41 that is provided at its bottom end with a dip tube 42 and at its top end with a holding collar 43. The pump also comprises an actuator rod 44 that is axially movable down and up inside the body 41, in such a manner as to cause the volume of a pump chamber (not shown) to vary. In an entirely conventional manner, the pump 4 is provided with an inlet valve and with an outlet valve at opposite ends of the pump chamber, such that the fluid may penetrate into the pump chamber through the dip tube 42 and the open inlet valve, and leave the pump chamber through the open outlet valve and the actuator rod 44 when said pump chamber has been put under pressure. This design is entirely conventional for a pump in the fields of perfumery, cosmetics, and pharmacy.

The fastener ring 5 makes it possible to mount the dispenser member 4 in stationary and leaktight manner in the reservoir 1. The fastener ring may even be incorporated with the dispenser member 4. The fastener means comprise: reception means 53 for receiving, in stationary and stable manner, the holding collar 43 of the body 41; a fastener skirt 51 that is engaged inside or outside the reservoir; and a plate 52 that may come into abutment against the top end of the reservoir. The particular design of the fastener ring 5 is not critical to the present invention.

The pusher 6 is mounted on the free end of the actuator rod 44 of the dispenser member 4. It includes a connection sleeve 61 that is engaged on the free end of the actuator rod 44. The connection sleeve 61 is extended by an inner duct 62 that leads to a dispenser orifice 63, e.g. in the form of a spray nozzle. This general design is entirely conventional for a pusher in the fields of perfumery, cosmetics, and pharmacy. Given that the pusher is not a critical element of the present invention, it does not need to be described in greater detail.

The fluid reservoir 1 comprises a cylinder 10 that is generally cylindrical. At its top end, the cylinder 10 defines a neck 11 inside which the fastener skirt 51 of the ring 5 is engaged in stationary and leaktight manner. At its bottom end, the cylinder 10 forms a bottom wall 13 that is provided with an opening 14 that is advantageously arranged in central manner. At the opening 14, the bottom wall 13 forms an annular shoulder 15 having a function that is explained below. At the central opening 14, the bottom wall 13 also defines a snap-fastener groove 16. On its outer wall, the bottom wall 13 forms a thread 17. The opening 14 passes right through the bottom wall, such that the inside of the reservoir 1 may communicate with the outside through the opening. In addition, the cylinder 10 also forms a vent channel 12 that extends over a major fraction of the height of the container 1. The vent channel includes an inlet 121 that is arranged in the proximity of the neck 11. However, this does not exclude the inlet 121 being arranged remote from the neck 11. The vent channel 12 also includes an outlet 122 that opens out at the bottom wall 13, beside the opening 14. The vent channel 12 is made integrally with the remainder of the reservoir 11. In entirely conventional manner, the reservoir with its vent channel 12 may be made by injection molding an appropriate plastics material. The vent channel 12 may be formed by means of a molding pin that is removed from said channel after molding. Advantageously, the molding pin may present a shape that tapers or that is frustoconical, such that the flow section of the vent channel 12 increases from the inlet 121 to the outlet 122. In FIG. 1, it should thus be observed that the vent channel 12 presents a configuration that flares towards the outlet 122. With such a configuration for a molding pin and a vent channel, it is guaranteed that the molding pin is more robust and that it is easier to unmold. It should be observed that the flow section of the vent channel 12 at its outlet 122 corresponds substantially to the diameter of the dip tube 42, which diameter lies in the range about 2 millimeters (mm) to 3 mm.

The filling valve 2 is mounted in the bottom wall 13 of the reservoir and extends mainly through the central opening 14. The filling valve 2 is formed by a stationary element 20 and a flexible part 25. In very general manner, the stationary element 20 forms a valve seat 24, and the flexible part 25 forms a movable member 27 that bears in selective and leaktight manner against the valve seat 24. In the absence of any fluid under pressure, the movable member 27 bears in leaktight manner against the seat 24. When the movable member is subjected to fluid presenting sufficient pressure, it lifts off from its seat in such a manner as to create a passage making it possible to connect the outside of the reservoir to the inside of the reservoir.

Figure 7:
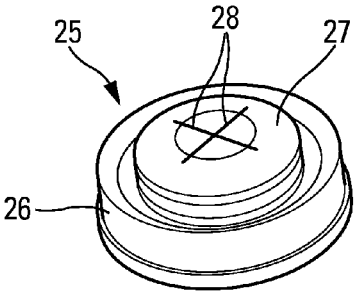
FIG. 7 is a perspective view of the movable member of the filling valve.

In greater detail, the flexible part 25 includes a flexible diaphragm 27 that presents a slot 28, e.g. in the shape of a cross that is very clearly visible in FIG. 7. The flexible diaphragm 27 is surrounded by an annular anchor band 26 that is for coming to bear against the shoulder 15 formed inside the opening 14 of the bottom wall 13. The top face of the diaphragm 27 is oriented towards the inside of the reservoir 1. Its bottom face bears against the valve seat 24 formed by the stationary element 20. More precisely, the stationary element 20 includes a rim 21 externally forming a snap-fastener bead 211 that is received in the snap-fastener groove 16 of the bottom wall 13 inside the opening 14. The top end of the rim 21 comes into contact with the anchor band 26 of the movable member 25 and pushes it hard against the shoulder 15. Thus, the flexible part 25 is held in stationary and leaktight manner inside the opening 14. The stationary element 20 also forms the valve seat 24 that comes into contact with the bottom face of the flexible diaphragm 27. The valve seat 24 may be in the form of a stud that is arranged coaxially inside the rim 21. The stud may be connected to the rim 21 by a plurality of axial bars, so as to define between them feed ducts 242 that lead to the bottom face of the flexible diaphragm 27. On its bottom face, the valve seat 24 may form one or more abutment lugs 241 against which a reception housing 23 opens out.

Figure 3:
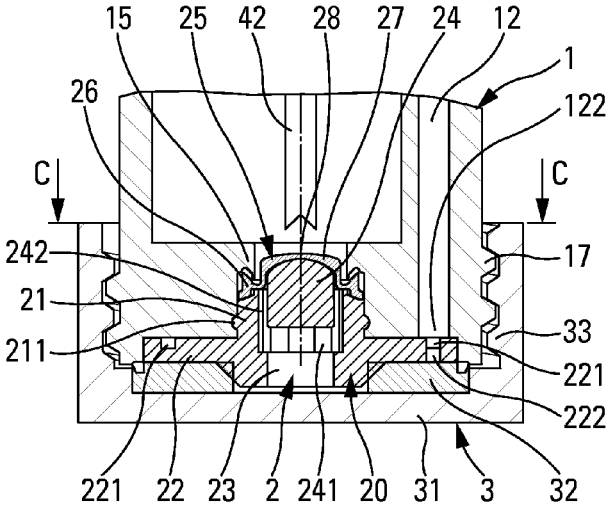
FIG. 3 is a larger-scale view of the bottom portion of the FIG. 1 dispenser.
Figure 4:
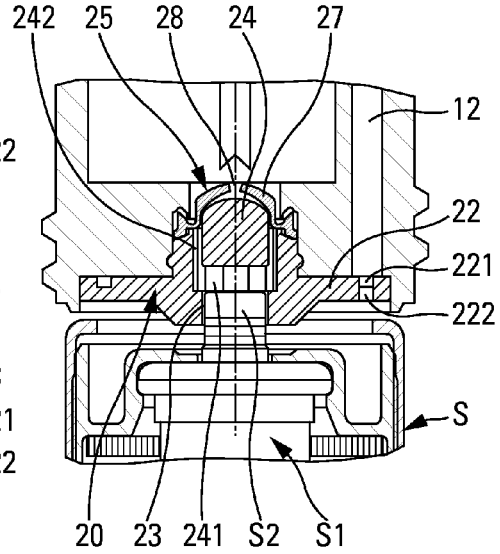
FIG. 4 is a view similar to the view in FIG. 3 during a filling operation.

With reference to FIG. 3, it is possible to see the filling valve 2 in its rest state. The flexible diaphragm 27 bears in leaktight manner against the valve seat 24. In FIG. 4, the free end of an actuator rod S2 of a dispenser member S1 that forms part of a source bottle S is engaged inside the reception housing 23 in such a manner as to come into abutment against the lugs 241. By pressing the actuator rod S2 hard into the housing 23, the dispenser member S1 is actuated and fluid under pressure is forced through the actuator rod in such a manner as to flow under pressure through the feed ducts 242 so as to reach the bottom face of the flexible diaphragm 27 that is then lifted, widening the slot 28. The fluid may then penetrate into the reservoir 1. It should be observed that the filling valve 2 is opened under the action of the fluid under pressure, and not by the mechanical pressure directly exerted by the actuator rod S2.

The stationary element 20 also forms a disk 22 that extends radially outwards from the rim 21. The disk 22 may be made integrally with the rim 21: in a variant, the disk 22 may be fitted around the rim 21. The disk 22 comes into contact with the bottom face of the bottom wall 13 and covers the outlet 122 of the vent channel 12. In the invention, the disk 22 forms a vent passage that connects the outlet 122 of the vent channel 12 to the outside. By way of example, the vent passage may be formed by a vent hole 222 that passes through the thickness of the disk 22 and that is advantageously arranged at the outlet of the vent channel 12. Thus, the hole 222 directly connects the channel 12 to the outside. Advantageously, the hole 222 presents a flow section that is smaller than the flow section of the vent channel 12, and more particularly smaller than the flow section at its outlet 122. This is very clearly visible in FIGS. 1, 3, and 4. Thus, the vent hole 222 constitutes an outlet passage of section that is small compared to the section of the channel 12. Thus, any risk of leakage or of loss of fluid is avoided. The reduction in section imparted by the vent hole 222 makes it possible to mold the vent channel 12 with a molding pin of large section, thereby improving its solidity. In a preferred variant, the vent hole 222 is combined with an annular duct 221 that is arranged between the outlet 122 and the hole 222. By way of example, the annular duct 221 may be in the form of an annular groove 221' (visible in FIG. 6) that is formed in the top face of the disk 22. Once applied against the bottom face of the bottom wall 13, the annular groove 221' forms the annular duct 221. The annular duct is preferably circular and presents a diameter such that the annular duct 221 is arranged in alignment with the outlet 122 of the channel 12. As a result of the annular duct 221, it is no longer necessary to orientate the disk 22: the vent hole 222 may be situated anywhere relative to the outlet 122. The annular duct 221 also makes it possible to make a vent passage segment that is relatively long between the outlet 122 and the vent hole 222. Furthermore, the flow section of the annular duct 221 is much smaller than the flow section of the outlet 122, thereby reducing still further any risk of fluid leaking at the vent hole 222.

In this embodiment, the annular channel 221 and the vent hole 222 are formed by the disk 22 that forms an integral part of the stationary element 20. However, without going beyond the ambit of the invention, it is possible to form the annular duct 221 and the vent hole 222 in a disk that is fitted on the bottom wall of the reservoir, but that is not secured to the filling valve 2.

The removable cap 3 includes a bottom wall 31 that is provided with a sealing gasket 32 for flattening against the disk 22 in such a manner as to close the vent hole 222 in airtight manner. In order to compress the gasket 32, the cap 3 includes a threaded skirt 33 that may come into engagement with the thread 17 of the body reservoir elsewhere 1, as can be seen very clearly in FIG. 3. Naturally, the bottom wall 31 of the cap 3 also covers the filling valve 2.

Figure 5:
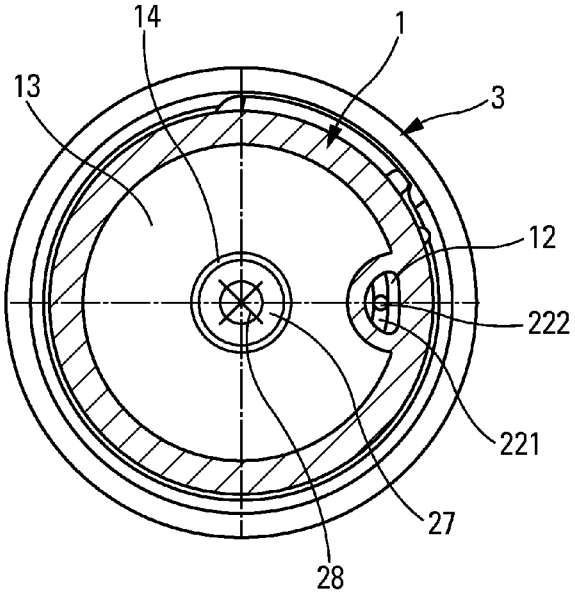
FIG. 5 is a view on section line C-C of FIG. 3.
Figure 6:
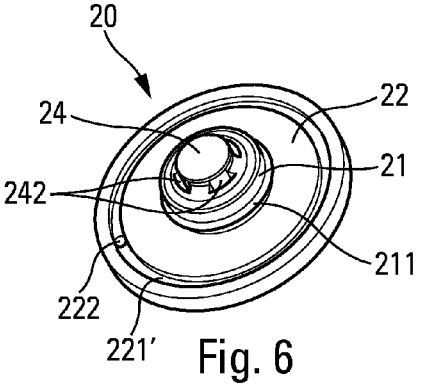
FIG. 6 is a perspective view of the stationary element of the filling valve.

In the configuration shown in FIG. 3, the dispenser may be used in conventional manner by actuating the pusher 6 so as to dispense doses of fluid. Once empty, the removable cap 3 may be removed and the actuator rod S2 of a source bottle S may be inserted into the reception housing 23, as shown in FIG. 4. It then suffices to depress the actuator rod S2 so as to dispense successive doses of fluid, which doses are injected into the reservoir through the filling valve, in which the flexible diaphragm 27 has been forced into its open state. FIG. 5 shows a cross-section view on section line C-C of FIG. 3. Through the vent channel 12, it is possible in particular to see a short section of the annular duct 221 and the vent hole 222. It is also possible to observe the flexible diaphragm 27 with its cross-shaped slot 28. In FIG. 6, it is possible to observe the top ends of the feed ducts 242 that extend between the rim 21 and the valve seat 24. The rim 21 is surrounded by the disk 22 that, in its top face, forms the annular groove 221' at the bottom of which the vent hole 222 is formed.

By means of the present invention, the vent channel may be made integrally with the reservoir without having to reduce, in dangerous manner, the section of the molding pin, given that the vent channel communicates with the outside through a vent passage having a flow section that is small.

What is claimed is:

1. A refillable fluid dispenser comprising:

a fluid reservoir defining a neck at a first end and a bottom wall provided with an opening;

a filling valve that is mounted in the opening of the bottom wall, the filling valve including a movable member and a valve seat for the movable member;

a dispenser member that is mounted on the reservoir so as to take the fluid, the dispenser member including a body and an actuator rod that is axially movable down and up;

a pusher that is mounted on the actuator rod of the dispenser member; and a vent channel that extends along the fluid reservoir so as to put the fluid reservoir into communication with the outside, the vent channel defining an inlet in the proximity of the neck, and an outlet that opens out at the bottom wall, the vent channel being made a one-piece integral construction with the fluid reservoir, the one-piece integral construction extending from the inlet to the outlet of the vent channel;

the dispenser comprising a stationary element that is a separate element mounted on the bottom wall of the fluid reservoir, the stationary element forming a vent passage that connects the outlet of the vent channel to the outside.

2. A dispenser according to claim 1, wherein the outlet of the vent channel presents a flow section that is larger than the flow section of the inlet.

3. A dispenser according to claim 1, wherein the vent channel presents a configuration that flares towards its outlet.

4. A dispenser according to claim 1, wherein the vent passage presents a flow section that is smaller than the flow section of the outlet.

5. A dispenser according to claim 1, wherein the vent passage comprises a vent hole that is arranged at the outlet.

6. A dispenser according to claim 1, wherein the vent passage comprises an annular duct and a vent hole, the annular duct connecting the outlet to the vent hole.

7. A dispenser according to claim 1, wherein the stationary element includes a disk that is provided with an annular groove in which there is formed a vent hole that passes through the thickness of the disk.

8. A dispenser according to claim 1, wherein the stationary element also forms the valve seat of the filling valve.

9. A dispenser according to claim 1, wherein the movable member of the filling valve comprises a slotted flexible diaphragm that bears in leaktight manner on the valve seat, in the rest position.

10. A dispenser according to claim 9, wherein the slotted flexible diaphragm is formed by a flexible part that further includes an annular anchor band in which the slotted flexible diaphragm extends, the annular anchor band being jammed between the bottom wall and the stationary element.

11. A dispenser according to claim 1, further comprising a removable cap that covers the stationary element in airtight manner.

12. The dispenser according to claim 2, wherein the vent channel presents a configuration that flares towards its outlet.

13. The dispenser according to claim 1, wherein the dispenser member is a pump.

14. A refillable fluid dispenser comprising:

a fluid reservoir defining a neck at a first end and a bottom wall at an end opposite the first end, the bottom wall provided with an opening;

a filling valve mounted in the opening of the bottom wall, the filling valve including a movable member and a valve seat for the movable member;

a dispenser member mounted on the reservoir so as to take the fluid, the dispenser member including a body and an actuator rod that is axially movable down and up;

a pusher that is mounted on the actuator rod of the dispenser member; and a vent channel that extends along the fluid reservoir so as to put the fluid reservoir into communication with the outside, the vent channel defining an inlet proximate the neck, and an outlet that opens out at the bottom wall, the vent channel being made as a one-piece integral construction with the fluid reservoir;

the dispenser comprising a fixed element that remains stationary and is mounted on the bottom wall of the fluid reservoir, the fixed element forming a vent passage that connects the outlet of the vent channel to the outside.

15. The dispenser according to claim 1, wherein the vent channel is molded integrally with the fluid reservoir.

* * * * *